United States Patent [19]

Minnick

[11] Patent Number: 5,074,504

[45] Date of Patent: Dec. 24, 1991

[54] FLOWERPOT HOLDER

[76] Inventor: Bruce T. Minnick, 816 B Raspberry St., Erie, Pa. 16502

[21] Appl. No.: 622,951

[22] Filed: Dec. 6, 1990

[51] Int. Cl.[5] ..... A47K 1/08

[52] U.S. Cl. ..... 248/312.1; 47/67

[58] Field of Search ..... 248/312.1, 310, 311.2, 248/313; 47/67, 39, 66; 220/18, 85 R; 211/88; D6/556

[56] References Cited

U.S. PATENT DOCUMENTS

| | | | |
|---|---|---|---|
| D. 191,874 | 12/1961 | Yegge | D6/566 |
| 2,006,083 | 6/1935 | Dixon | 248/312.1 X |
| 2,541,390 | 2/1951 | Weigand | 248/312.1 X |
| 2,879,966 | 3/1959 | Carroll | 248/312.1 |
| 2,967,691 | 1/1961 | Lehnbeuter | 47/67 X |
| 3,001,753 | 9/1961 | Smith | 248/312.1 X |
| 3,464,391 | 9/1969 | Prentice | 248/312.1 X |
| 4,422,610 | 12/1983 | Hunt | 47/39 X |

FOREIGN PATENT DOCUMENTS

| | | | |
|---|---|---|---|
| 2123679 | 2/1984 | United Kingdom | 47/67 |

*Primary Examiner*—J. Franklin Foss

*Attorney, Agent, or Firm*—Ralph Hammar

[57] ABSTRACT

A flowerpot holder having an inverted hook section receiving the rim of the pot, a shoulder supporting the lower edge of the rim and a flat section complementary to the lower end of the pot for holding the pot level.

5 Claims, 1 Drawing Sheet

FLOWERPOT HOLDER

This invention is a fixture for supporting flowerpots on walls, railings and the like which is easy to install and will accommodate flowerpots of a wide range of sizes.

Figure 4:
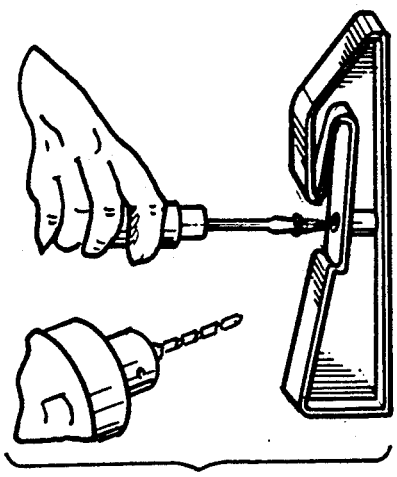
FIG. 4 is a diagrammatic view of the installation.

The fixture which can be easily made from plastic has an upright body 1 with a flat back wall 2 which rests against a flat surface of a supporting structure 5 and a front wall 3 which receives and supports a flowerpot. The body has a screw receiving hole 4 for attachment in load carrying relation to the support 5. A tubular reinforcing section 6 surrounds the screw hole and connects the front and back walls 2, 3 and serves as a pilot for the screw (FIG. 4). The front and back walls are further connected by a reinforcing web 7. On the upper end of the body the wall 3 is shaped to form a depending inverted hook structure 8 with its lower end 9 spaced above a load carrying shoulder 10 to provide a way 11 through which the rim 12 of a flowerpot may be inserted. The way also provides access for a screw driver for fastening the fixture to its support.

The lower end section 13 of wall 3 is formed at an angle complementary to the tapered lower end of the flowerpot. The combination of the shoulder 10 and the flat section 13 of wall 3 support any one of several different sizes of flowerpot in an upright level position. The line contact of the conical surface of the flower pot with the flat surface 13 centers the flower pot to a level position where the maximum support is provided. Line contact between the flat surface 13 and the convex surface of the pot is possible only when the pot is level. The weight of the pot resists any attempts to move the pot out of level.

Figure 1:
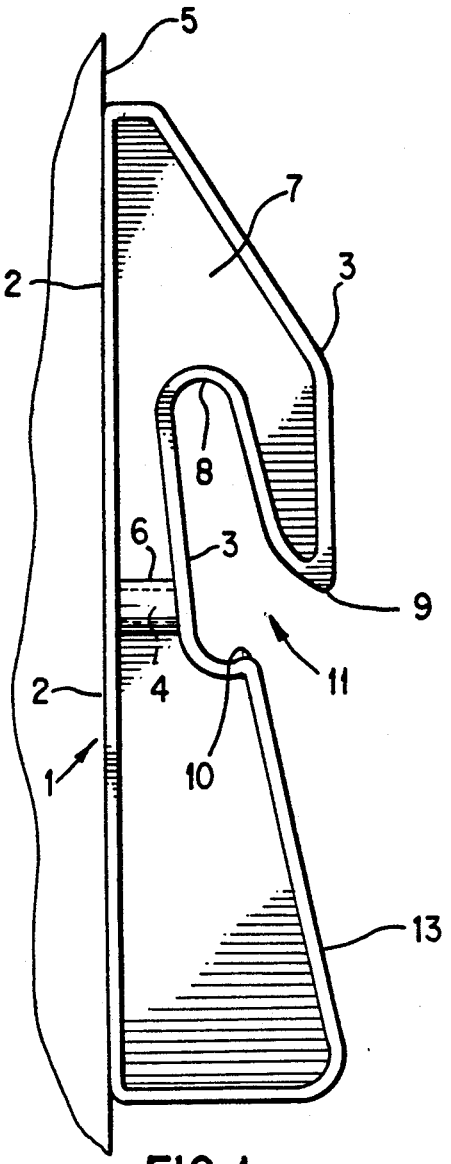
FIG. 1 is a side elevation of the fixture.
Figure 2:
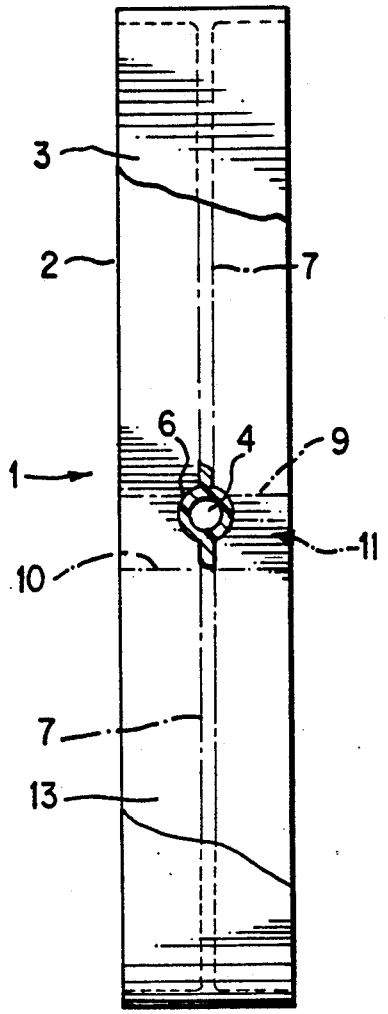
FIG. 2 is a front view partly broken away.
Figure 3:
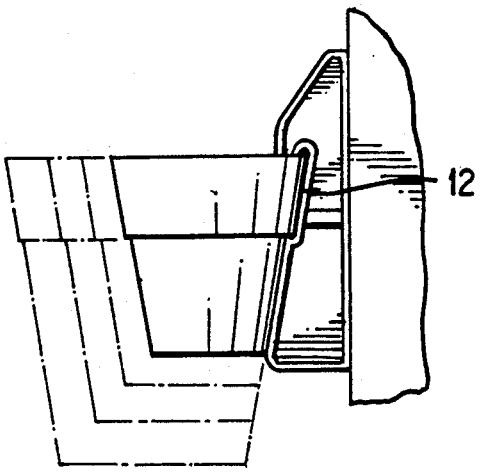
FIG. 3 is diagrammatic view showing the support of several sizes of pots.

As diagrammatically shown in FIG. 3, the particular fixture shown supports several sizes of pots from 4" through 8" in diameter so changes in the pot sizes used in a decorating pattern do not require changing the fixtures.

I claim:

1. A flowerpot holder having front and back walls connected by a web, the back wall being flat and the front wall being indented to provide an upwardly extending reentrant section for receiving the rim of a flowerpot and a load carrying shoulder on the lower end of said reentrant section and the lower end of said front all has a section complementary to the lower end of said flowerpot and a way through which the rim of a flowerpot may be inserted and mounted on said shoulder.

2. The structure of claim 1 in which the web has a tubular screw receiving section above said shoulder receiving a screw for mounting the fixture on a support.

3. The structure of claim 1 in which the section complementary to the lower end of said flowerpot is flat.

4. A flowerpot holder having a front wall indented to provide an upwardly extending reentrant section for receiving the rim of a flowerpot and a load carrying shoulder on the lower end of said reentrant section and the lower end of said front wall has a section complementary to the lower end of said flowerpot and a way through which the rim of a flowerpot may be inserted and mounted on said shoulder.

5. The flowerpot holder of claim 4 in which the section complementary to the lower end of the flowerpot is flat.

* * * * *